US006695424B2

(12) United States Patent
Hakkaku et al.

(10) Patent No.: US 6,695,424 B2
(45) Date of Patent: Feb. 24, 2004

(54) PRINTING DEVICE AND PRINTING METHOD

(75) Inventors: Kunio Hakkaku, Minamiashigara (JP); Hiroyuki Sato, Tokyo (JP); Shuichi Aratsu, Tokyo (JP); Hitoshi Yauchi, Tokyo (JP); Tatsuo Sugawara, Tokyo (JP); Koichi Sugiyama, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 103 days.

(21) Appl. No.: 10/014,336

(22) Filed: Dec. 10, 2001

(65) Prior Publication Data

US 2002/0080203 A1 Jun. 27, 2002

Related U.S. Application Data

(63) Continuation of application No. 08/669,995, filed on Jun. 25, 1996, now abandoned.

(30) Foreign Application Priority Data

Jun. 27, 1995 (JP) ..... 7-182222
Sep. 8, 1995 (JP) ..... 7-230987
Sep. 21, 1995 (JP) ..... 7-243320

(51) Int. Cl.[7] ..... B41J 29/38
(52) U.S. Cl. ..... 347/14
(58) Field of Search ..... 347/104, 16, 14; 400/613, 708; 101/407.1; 226/100; 242/344, 563; 116/200, 201, DIG. 41; 492/9, 10, 47

(56) References Cited

U.S. PATENT DOCUMENTS

| | | | | |
|---|---|---|---|---|
| 5,351,071 | A | 9/1994 | Matsuda et al. | 346/136 |
| 5,352,049 | A | 10/1994 | Shiraishi et al. | 400/208 |
| 5,519,428 | A | 5/1996 | Van Peteghem | 347/215 |

FOREIGN PATENT DOCUMENTS

| | | |
|---|---|---|
| JP | 58022178 | 2/1983 |
| JP | 60048367 | 3/1985 |
| JP | 63237970 | 10/1988 |
| JP | 03146356 | 6/1991 |
| JP | 04045959 | 2/1992 |
| JP | 05147295 | 6/1993 |
| JP | 05330122 | 12/1993 |
| JP | 06031967 | 2/1994 |
| JP | 06226963 | 8/1994 |

*Primary Examiner*—Michael S. Brooke
(74) *Attorney, Agent, or Firm*—Charles N. Quinn, Esq.

(57) ABSTRACT

A printing device for printing on a supplied paper, said printing device being provided therein with ink ejecting elements for ejecting ink from ink flow paths having nozzles on its front end and formed in ink jet head, and with a controlling means for electrically controlling said ink ejecting elements, said printing device being characterized in that said controlling means is constructed such that electric controlling conditions with respect to said ink ejecting elements are varied according to types of ink used. By such a construction, it becomes possible to drive ejecting elements in an excellent driving conditions adapted to type of ink used, thereby to deliver ink onto paper in a stable manner for carrying out a good quality of printing.

15 Claims, 9 Drawing Sheets

PRINTING DEVICE AND PRINTING METHOD

CROSS-REFERENCE TO RELATED APPLICATION

This application is a continuation from application Serial No. 08/669,995 filed Jun. 25, 1996 now abandoned, for "PRINTING DEVICE AND PRINTING METHOD" pursuant to 35 U.S.C. 119 and 120.

BACKGROUND OF THE INVENTION

This invention relates to printing device like a printer and printing method. More specifically, this invention relates to a printing device for ejecting ink onto paper for printing, said device being able to carry out adequate printing according to type of the paper used, a printing method used in said device, and an intermediate holding mechanism having holders to be used for charging paper roll of paper used onto said printing device.

In general, said printing device comprises a plurality of ink flow paths provided in ink jet head and having each nozzle at its front end, ejecting elements for ejecting outwards ink contained in said respective ink flow paths, and electrical controller for electrically controlling said ejection elements.

When using electrostrictive vibrator as said ejecting element, at least a part of walls of said ink flow paths is formed by flexible materials, and said electrostrictive vibrator is mounted on said walls. Said vibrator is electrically controlled by a controller at a predetermined timing, thereby to decrease the cross section of said ink paths to eject outwards ink contained therein, thus printing on paper.

When using thermal head as said ejecting element, a thermal head is provided on walls of said ink flow paths. Particular heating elements of said thermal head are electrically activated at a predetermined printing timing controlled by electrically controlling means, thereby to cause thermal expansion of ink contained in ink flow paths and to eject ink therein onto paper for printing thereof.

Heretofore known type of said printing device having electrostrictive vibrator is described herein below with reference to FIG. 1 and FIG. 2.

With reference to FIG. 1, in front of a cylindrical platen 1, a pair of carriage shafts 2, 2 are provided in a direction parallel to the axis of said platen 1, and a carriage 3 is provided on said carriage shafts 2 in a reciprocating manner. Said carriage 3 has an ink jet unit 4 for full color printing mounted thereon.

As shown in FIG. 2, said ink jet unit 4 has thereon 4 ink jet heads 5 corresponding respectively to four colors for full color printing and located each against said platen 1. Each ink jet head 5 has corresponding nozzle 6, these nozzles 6 being arranged in parallel manner to each other and opposing to said platen 1 as shown in FIG. 2. Said ink jet heads 5 are fixed on a head mounting member 7 which is in turn supported by said carriage 3.

A plurality of inlets 9 containing each auxiliary tanks 8 as buffer tanks for communicating with said respective nozzles 6 provided in said ink jet heads 5 are mounted on said carriage 3 behind said respective ink jet heads 5. Said respective inlets 9 are communicating with respective ink cartridges 10 of corresponding colors mounted detachably on said carriage 3.

On the outer side of one end of said platen 10, there is provided a pump unit 11 which is used for covering said nozzles 6 when not used to prevent ink therein from evaporating and for removing air bubbles or foreign substances stacked in said nozzles 6. Said pump unit 11 has a casing 13 having an opening 12 on the side of said carriage 3, said opening 12 having herein a cap body 14 which is reciprocally movable in the direction of said ink jet unit 4. Said cap body 14 has a plurality of openings 15 formed in a vertical oblong form so as to cover corresponding ink jet heads 5. Said each opening 15 has therein a gum liner 16, said liner 16 projecting outside from inside of circumference of said opening 15 to be pressed onto the circumference of corresponding ink jet head 5 in a airtight manner.

Said ink jet heads 5 comprises a plurality of ink flow paths 17 arranged in parallel and communicating with respective nozzles 6, each of said ink flow paths 17 having thereon corresponding piezo electric elements 18 as electrostrictive vibrators for ejecting ink from the front end of respective nozzles 6.

On the one hand, said cap body 134 of pump unit 11 has an approximately semispherical protrusion 19 provided on the front upper side thereof, and an air pressure channel 20 is formed from the summit of said protrusion 19 up to the rear side surface of said cap body 14, a pressurizing means such as pump (not shown) being connected to said air pressure channel 20. Said respective openings 15 of said cap body 14 is communicated with venting valves (not-shown) through communicating channels 22. Further, said respective openings 15 are provided with fluid exhausting pipes 23. These exhausting pipes 23 are connected to corresponding absorbing means such as pumps (not-shown) which absorb remaining portion of ink from respective opening 15 to be stored in a waste ink tank (not-shown).

On the other hand, an air pressure channel 25 is provided on the upper portion of side surface of said head mounting member 7 opposing to said pump unit 11, said air pressure channel 25 being used for receiving said protrusion 19 in a nozzle touch manner therein to communicating with said pressure air channel 20 when said pump unit 11 covers said ink jet unit 4. Said air pressure channel 25 is further branched into four branch channels 26 corresponding in number to said ink cartridges 10. The end portion of said respective branch channels 26 is connected to air pipes 27 communicating respectively with the upper portion of respective ink cartridges 10.

In the construction as described above of heretofore known printing device, said cap body 14 of said pump unit 11 is first put aside when printing, and said carriage 3 mounting said ink jet unit 4 is run along said platen 1, while at the same time said piezo electric elements 18 of said nozzles 6 for printing use are driven by feeding electricity thereto on the basis of predetermined printing signals, thereby feeding ink from said ink cartridges 10 through said inlets 9 into said ink flow paths 17 and ejecting through said nozzles 6 onto printing paper on said platen.

In general, the coloring materials used in ink for printing devices are divided into two types, that is dyestuff and pigment. The dyestuff type is superior to said pigment type in the freshness of colors while rather weak when exposed to water and light. On the other hand, said pigment type is inferior to said dyestuff type in freshness of colors while strong against water and light.

With respect to printing paper, there are two types of papers, one type being easier to absorb or receive ink and the other type being rather hard to receive ink. In the former type of paper, absorbed ink is more rapidly diffused, so that the total amount of ink used is less than that of the latter type of paper which is more hard to absorb ink. However, the former type of paper which absorbs more easily ink has inferior to the latter type due to said ink diffusion phenomenon.

Since ink and paper have different physical characteristic as described above, it must be advantageous to use different types of ink and paper in a single printing apparatus thereby to settle different printing conditions for obtaining a wide variety of printing.

However, only one type of ink could be used in the heretofore known printing devices.

This is because the upper limits of electricity feeding conditions such as voltage and frequency for driving ink jet head are different for different types of coloring agent used in an ink even when physical characteristics such as viscosity and surface tension of ink are held constant, so that, if driving pressure and frequency corresponding to the type of coloring agent are not used for driving ink jet head, a constant direction of ink ejection can not be obtained, resulting in a poor printing quality.

Further, with respect to the type of paper used, only a particular type of paper can be used for a particular ink used due to variations of printing quality caused by the absorbing capacity of ink used.

Table 1 shows the results of a printing test on various types of paper using a dyestuff type ink in the conventional printing device.

TABLE 1

| Type of Ink | Type of Paper | Printing Mode | Result | Remark |
|---|---|---|---|---|
| Dyestuff | Fine type | Standard | Good | |
| Dyestuff | Back Print | Standard | Good | |
| Dyestuff | Cloth | Standard | Good | |

As shown in Table 1, any type of paper such as fine type, back print type and cloth could be printed with good result in a standard printing mode by using a dyestuff type of ink.

Table 2 shows a printing test on various types of paper using pigment type of ink in a heretofore known printing device.

TABLE 2

| Type of Ink | Type of Paper | Printing Mode | Result | Remark |
|---|---|---|---|---|
| Pigment | Fine type | Standard | Bad(*1) | (*4) |
| Pigment | Back Print | Standard | Bad(*2) | (*4) |
| Pigment | Cloth | Standard | Bad(*3) | (*4) |

Remarks:
(*1): (at high concentration, ink is not absorbed by paper)
(*2): (only at black color, low concentration)
(*3): (all at four colors, low concentration)
(*4): Direction of ink ejection not constant, with no ink ejection.

As shown in Table 2, when printing was carried out using a pigment type ink at standard printing mode, good printing could not obtained on any type of paper. This is due to the fact that said ink jet heads 6 were driven at the same electricity feeding conditions as those in the case using dyestuff type ink in spite of using herein pigment type ink in place of dyestuff type ink, with the results that the ejection direction of ink was not constant and ink could not ejected.

With respect to paper used in this test, ink was not absorbed into paper at places having higher ink concentration when using a fine type paper. When using back print type paper, black ink was so much absorbed in this type of paper, with the result that only black color had a low concentration. Lastly, when using cloth as printing paper, all of four color lines have been absorbed too much into paper, with the result of four colors having each lower concentration.

In general, users of printing device have input the type of paper used into printing device by any means. One of these means has been setting of the type of paper on the operating panel of printing device by user. More recently, the information about type of paper to be used is often transferred into printing device from personal computer together with printing data. In the last case, user selects his desired type of paper from Paper Menu printed on a software called Printer Driver containing types of paper such as common paper, coat paper, film for a overhead projector (OHP), back print film, burnished paper and the like.

On the other hand, while there are several cases where one can easily discriminate paper used by means of appearance thereof and touch feeling thereon, there are so many papers which have resembling appearance and feeling. Therefore, when users set erroneously types of paper, printing can not be carried out at printing conditions adapted to the type of paper used, resulting in undetected printing quality.

While it is possible to discriminate types of paper used through its factors such as surface roughness, light transparency and rigidity, but it is not practical to mount detection mechanism for that purpose upon printing device, because one detection device is necessary for anything of said paper factors, thus increasing considerably the cost of printing device. When detecting type of paper using the factor of light transparency, only three states of paper, i.e. transparent, translucent and opaque, which limits adoptation to more and more various types of paper. As described above, direct detection of paper type has been difficult in technical and economical view points.

SUMMARY OF THE INVENTION

Accordingly, this invention has as its object to deliver a printing device which can carry out always a high quality of printing while taking into consideration the types of ink and paper used, and having a means for automatically detecting the type of paper, and a printing method using said printing device as well as an intermediate holder for charging a roll of paper to be used into the printing device.

A printing device for printing on a supplied paper described in claim 1, said printing device being provided therein with ink ejecting elements for ejecting ink from ink flow channel having nozzles on its front end and formed in ink jet head, and with a controlling means for electrically controlling said ink ejecting elements, is characterized in that said controlling means is constructed such that electric controlling conditions with respect to said ink ejecting elements are varied according to types of ink used. Such a construction of printing device allow for driving its ejecting components with a good driving conditions adapted to type of ink, thereby to deliver ink in a stable manner to carry out good quality of printing.

A printing device according to claim 2 is characterized in that said electric controlling means is such that image processing depending on ink ejecting number from nozzles is varied correspondingly to type of paper used. Such a construction allows for image processing adapted to type of paper thereby to carry out good quality of printing.

A printing device according to claim 3 is characterized by a paper roll holding mechanism for holding said paper roll by means of holders attached to both end portions of a roll of said paper, by a holder engaging member which is movable and can be applied onto peripheral surface of one of said holders of said paper roll held by said paper roll holding mechanism, by a paper type detection unit for detecting type of said roll paper according to the position of said holder engaging correspondingly to outer diameter of said holder representing type of said roll paper used, and by roll paper discriminating means for discriminating type of roll paper based on said paper type detection unit. In such a construction, said paper type detection means can automatically detect type of paper only by mounting a holder, outer diameter of which is adapted to type of roll paper.

A printing device according to claim 4 is characterized by a plurality of fixed sensors outputting each switching signals, and by state setting member for setting said respective sensors at open or close state correspondingly to stopped position of said holder engaging member. With such a construction of printing device, type of paper can be detected by combination of switching signals output from respective sensors.

A printing device according to claim 5 is characterized by a paper roll holding mechanism for holding said paper roll by means of holders attached to both end portions of a roll of said paper, by a paper type detection unit for detecting type of said roll paper according to color element of said holder representing type of said roll paper used, and by roll paper discriminating means for discriminating type of roll paper based on said paper type detection unit. With such a construction, type of roll paper can be detected by means of color element of holder.

A printing device according to claim 6 is characterized in that said paper type detection unit is composed of sensors which discriminate at least one of two factors, i.e. color type and color concentration of color applied on peripheral surface of said holder. Thus, it is possible to detect type of roll paper by means of color and its concentration of color element of said holder.

A printing device according to claim 7 is characterized by a paper roll holding mechanism for holding said paper roll by means of holders attached to both end portions of a roll of said paper, by a holder engaging member which is movable and can be applied onto peripheral surface of one of said holders of said paper roll held by said paper roll holding mechanism, by first paper type detection unit for detecting type of said roll paper according to the position of said holder engaging member located correspondingly to outer diameter of said holder representing type of said roll paper used, second paper type detection unit for detecting type of said roll paper according to color of said holder representing type of said roll paper used, and by roll paper discriminating means for discriminating type of roll paper based on both outputs of said first and second paper type detection units.

Further, said printing device according to claim 8 is characterized in that said first paper type detection unit comprises a plurality of fixed sensors outputting each switching signals, and by state setting member for setting said respective sensors at open or close state correspondingly to stopped position of said holder engaging member, and said second paper type detection unit comprises sensors which discriminate at least one of two factors, i.e. color type and color concentration of color applied on peripheral surface of said holder. Thus, said state setting members set respective sensor of said first paper type detection unit in open state or in close state according to stopped position of said holder engaging member, while sensors of said second paper type detection unit reads out color elements which are different correspondingly to paper type, so that type of paper can be detected by combination of said open and close signals from respective sensors and color elements of holders.

A printing device according to claim 9 is characterized by a cover member which is opened when exchanging said paper roll and a driven member which is driven by said opening operation of said cover member so as to shift said holder engaging member into a retraction position where it can not engage with said holder. A printing device according to claim 10 is characterized in that said holder engaging member engages with outer peripheral surface of holder body. A printing device according to claim 11 is characterized in that said holder engaging member engages with outer peripheral surface of a flange formed on said holder body. Under such a construction, it is possible to use both holder body itself and its flange as discriminating element of roll paper.

A printing device according to claim 12 is characterized in that different color inks are ejected from a plurality of ink jet heads. Thus, it is possible to adapt color printing to type of ink and/or paper used thereby to obtain a good quality of printing.

A printing method for printing on paper wound in the form of paper roll according to claim 13 is characterized by the steps of storing printing conditions for a plurality of paper types, discriminating type of paper used by reading discriminating elements provided on said paper roll, and carrying out printing based on corresponding printing conditions. Thus, it is possible to discriminate paper type upon mounting paper roll onto printing device without use of complicated structure of printing device and without the need of rotating paper roll.

Further, printing method claimed in claim 14 is characterized in that said discriminating element is single, type of paper is discriminated by said single discriminating element, and printing is carried out based on printing conditions corresponding to said discriminated paper. Further, a printing method claimed in claim 15 is characterized in that outer diameter of at least one of said holders mounted on paper roll is used as said discriminating element. Further, a printing method claimed in claim 16 is characterized in that color element of at least one of said holders mounted on paper roll is used as said discriminating element. A printing method claimed in claim 17 is characterized in that said color element comprises at least one of color and color concentration of said holder. A printing method claimed in claim 18 is characterized in that a plurality of said discriminating elements are used, wherein type of paper is discriminated by combination of said plurality of discriminating elements, and printing is carried out based on printing conditions corresponding to said detected paper type. Further, a printing method claimed in claim 19 which is characterized in that said plurality of discriminating elements comprise outer diameter of at least one of holders mounted on said paper roll and color elements of said holder. Further, a printing method claimed in claim 20 is characterized in that said color element comprises at least one of color and color concentration of said holder. Thus, it is possible to automatically detect type of roll paper by means of outer diameter and color element of holder and to increase the number of detectable paper types by increasing the number of discriminating elements.

An intermediate holding mechanism described in claim 21 having holders for charging paper roll comprising a core and roll paper wound on said core onto said printing device is characterized in that said holders are mounted concentrically on at least one end of said core, and that combination of outer diameter and color of peripheral surface of said holder is varied correspondingly to type of said roll paper. Thus, it is possible to detect types of various papers by means of paper type detection unit.

Further, an intermediate holding mechanism claimed in claim 22 is characterized by further auxiliary holders fitted into said holder for mounting said paper roll on said paper roll holding mechanism. Thus, it is possible to use auxiliary holder of the same shape when charging paper roll onto printing device thereby to obtain more stable charging of paper roll on printing device.

DETAILED DESCRIPTION OF THE INVENTION

First Embodiment, FIGS. 3–9

Figure 1:
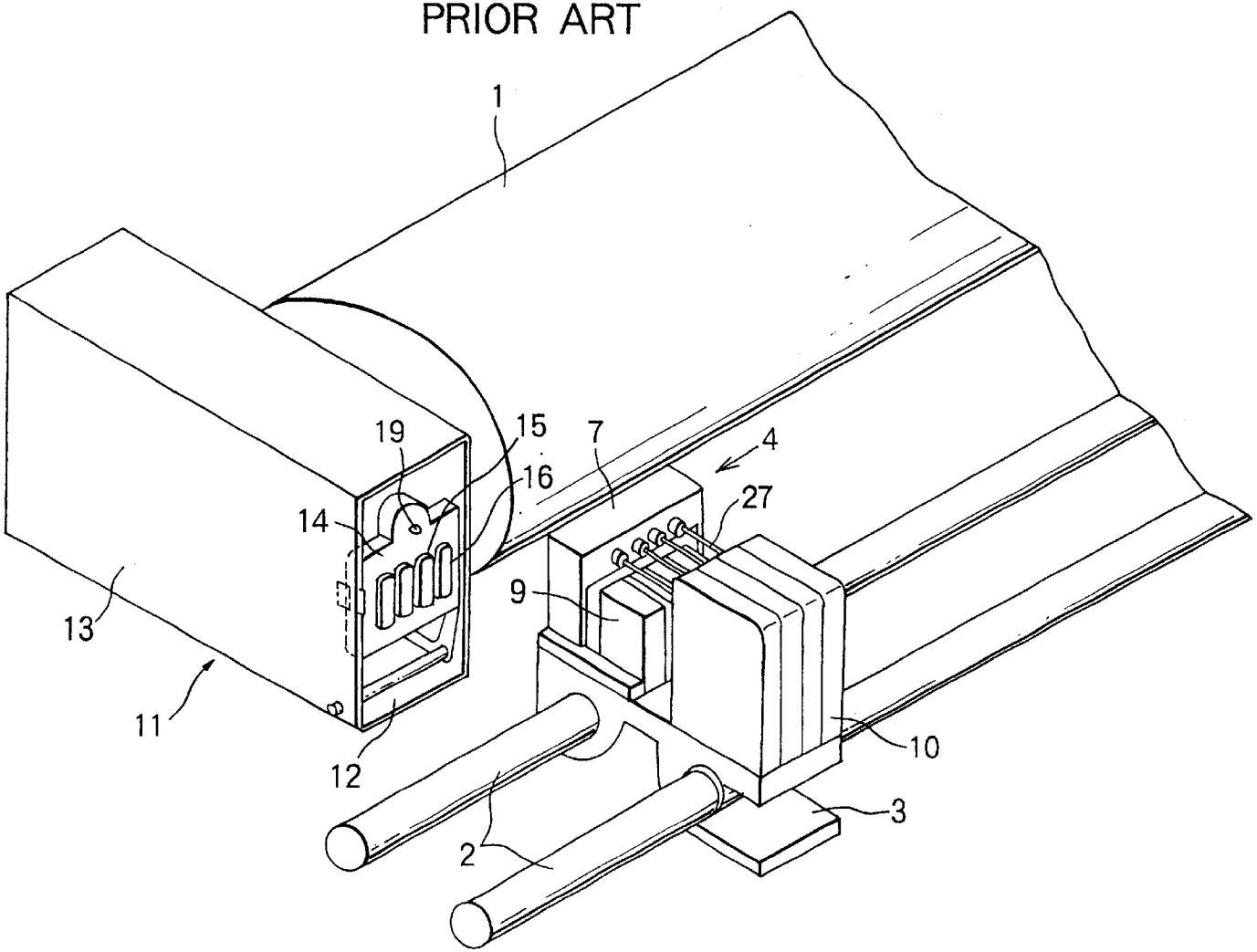
FIG. 1 PRIOR ART
FIG. 1 is a perspective view of essential portion of heretofore known printing device.
Figure 2:
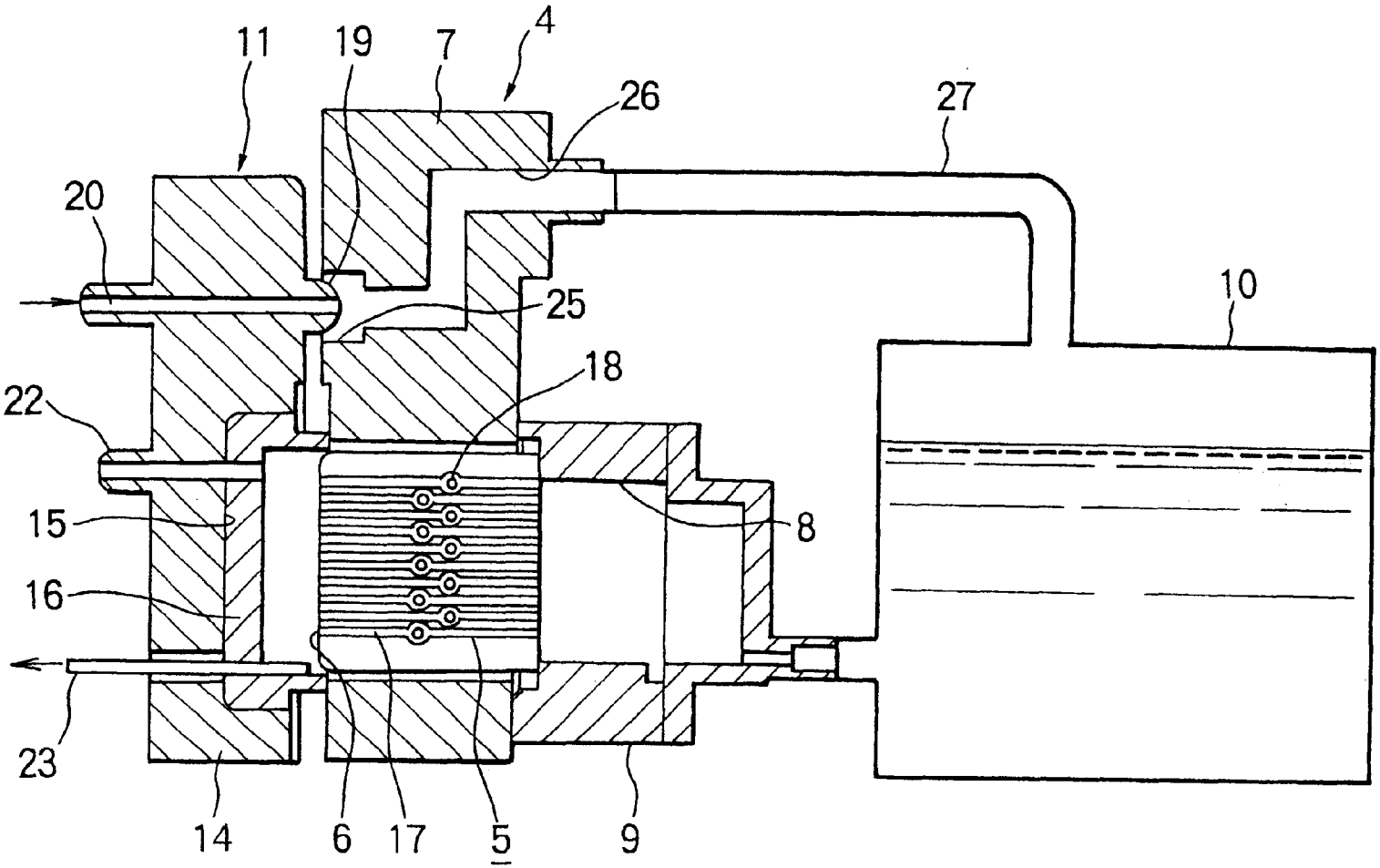
FIG. 2 PRIOR ART
FIG. 2 is a cross-sectional view of FIG. 1.
Figure 3:
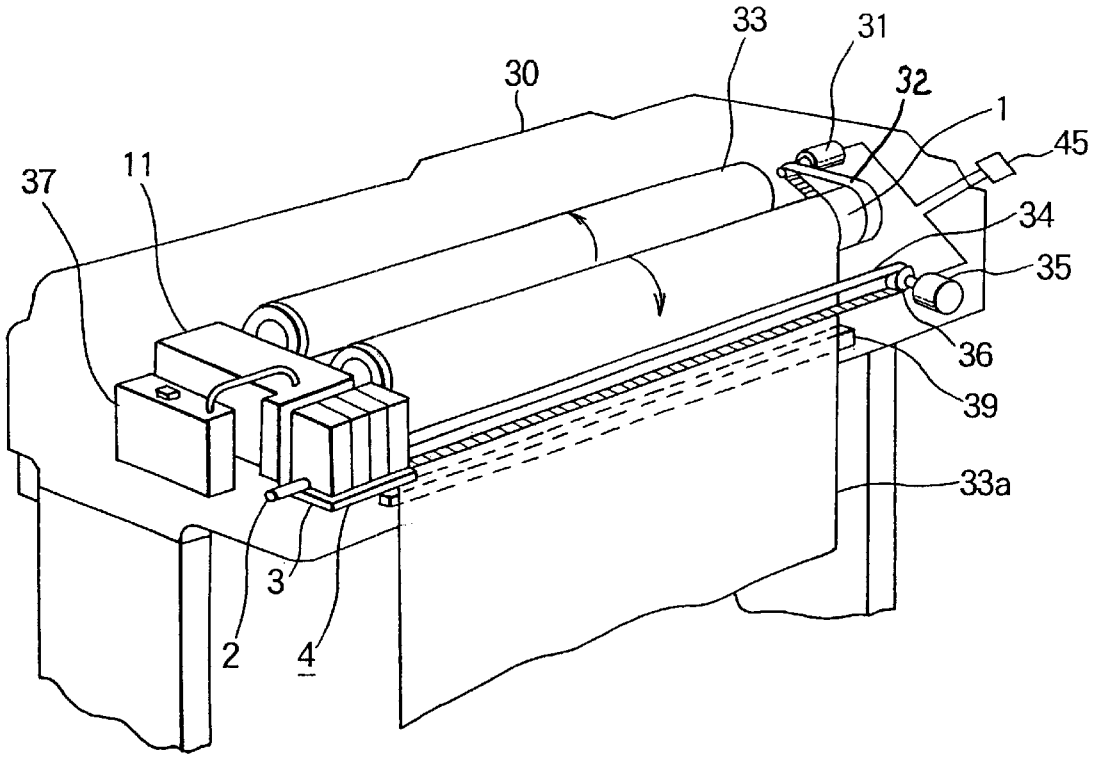
FIG. 3 is a perspective view showing a first embodiment of printing device according to the invention.
Figure 4:
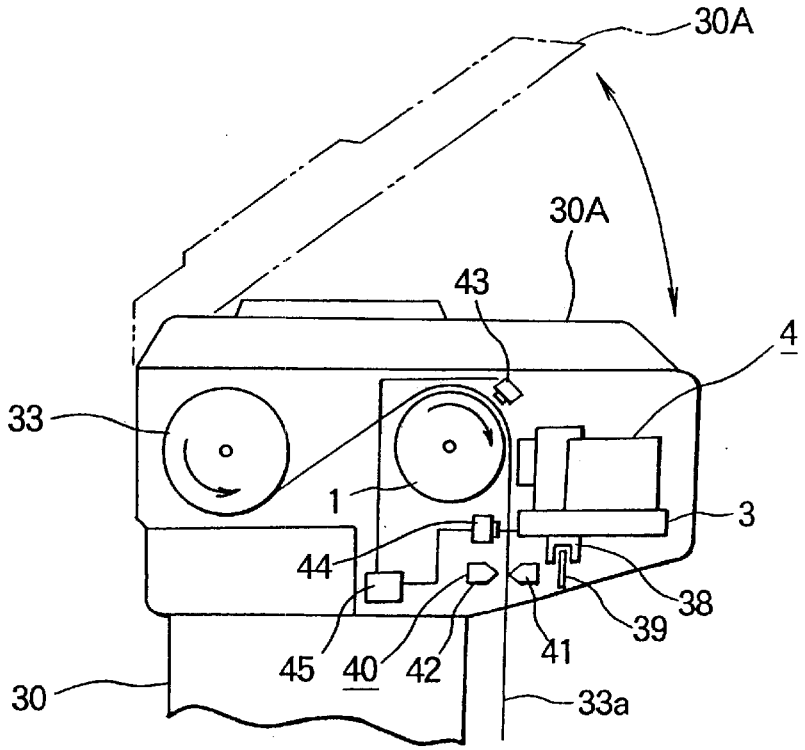
FIG. 4 is a partial side view of printing device shown in FIG. 3.

An embodiment of printing device according to the present invention as shown in FIG. 3 and FIG. 4, has a housing 30, in which a cylindrical platen 1 is rotatably mounted with its axis extending in horizontal direction. A driven pulley (not-shown) is supported by one end of said platen 1, a belt 32 driven by a first reversible motor 31 being wound on said driven pulley. Accordingly, said platen 1 can be driven by driving force of said first motor 31 in the normal transporting direction or in the reverse direction.

A paper roll 33 having an axis parallel to said platen 1 is mounted on the rear side of said platen 1 in said housing 30. When said paper roll 33 is rotated in counter-clock direction in FIG. 4, roll paper 33*a* to be used is released out of paper roll 33 to be wound on the upper side of said platen 1.

An ink jet unit 4 reciprocating along said platen 1 in a direction parallel to the axis thereof is provided in the space opposing to said platen 1 in said housing 30. A carriage 3 of said ink jet unit 4 has thereon a plurality of ink jet heads (not-shown) which are directed against said platen 1. A driving belt 34 is connected to said ink jet unit 4, and said driving belt 34 is wound about a driving pulley 36 which is driven by a second motor 35 of reversible type. Accordingly, when driving said second motor 35, said ink jet unit 4 is reciprocated along said platen 1 under the guidance of a carriage 2 located in parallel to said platen 1. A pump unit 11 for covering the nozzles of restrictive ink jet heads of said ink jet unit 4 for the purpose of recovering operation thereof is located on one side of the other end portion of said platen 1, and an exhaust liquid tank 37 is provided adjacent to said pump unit 11.

Photointerrupters 38 of transmission type are located with a distance therebetween in the front and back direction of said carriage 3 on the underside of said carriage 3 of said ink jet unit 4, and a linear encoder 39 comprising a thin plate having therein a number of small holes corresponding to printing resolution is located along the whole range of shifting ink jet unit 4.

Cutter 40 consisting of long sized fixed blade 41 and movable blade 42 for cutting printed roll paper 33*a* is located below said platen 1 and ink jet unit 4.

A first paper detector 43 for detecting roll paper 33*a* on said platen 1 is located on the upstream side of said ink jet unit 4 in the normal conveying direction of said roll paper 33*a* so as to oppose to said platen 1, while second paper detector 44 is located between said ink jet unit 4 and said cutter 40. Said both paper detectors 43, 44 and said both motors 31, 35 are respectively connected to a controller 45 of printing device, so that when signals about roll paper 33*a* from said paper detectors 43, 44 are input into said controller 45, this controller 45 controls said respective motor 31, 35 correspondingly to the input signals.

As shown further in FIG. 4, the upper opening (not-shown) is covered by a closing cover 30A.

Figure 5:
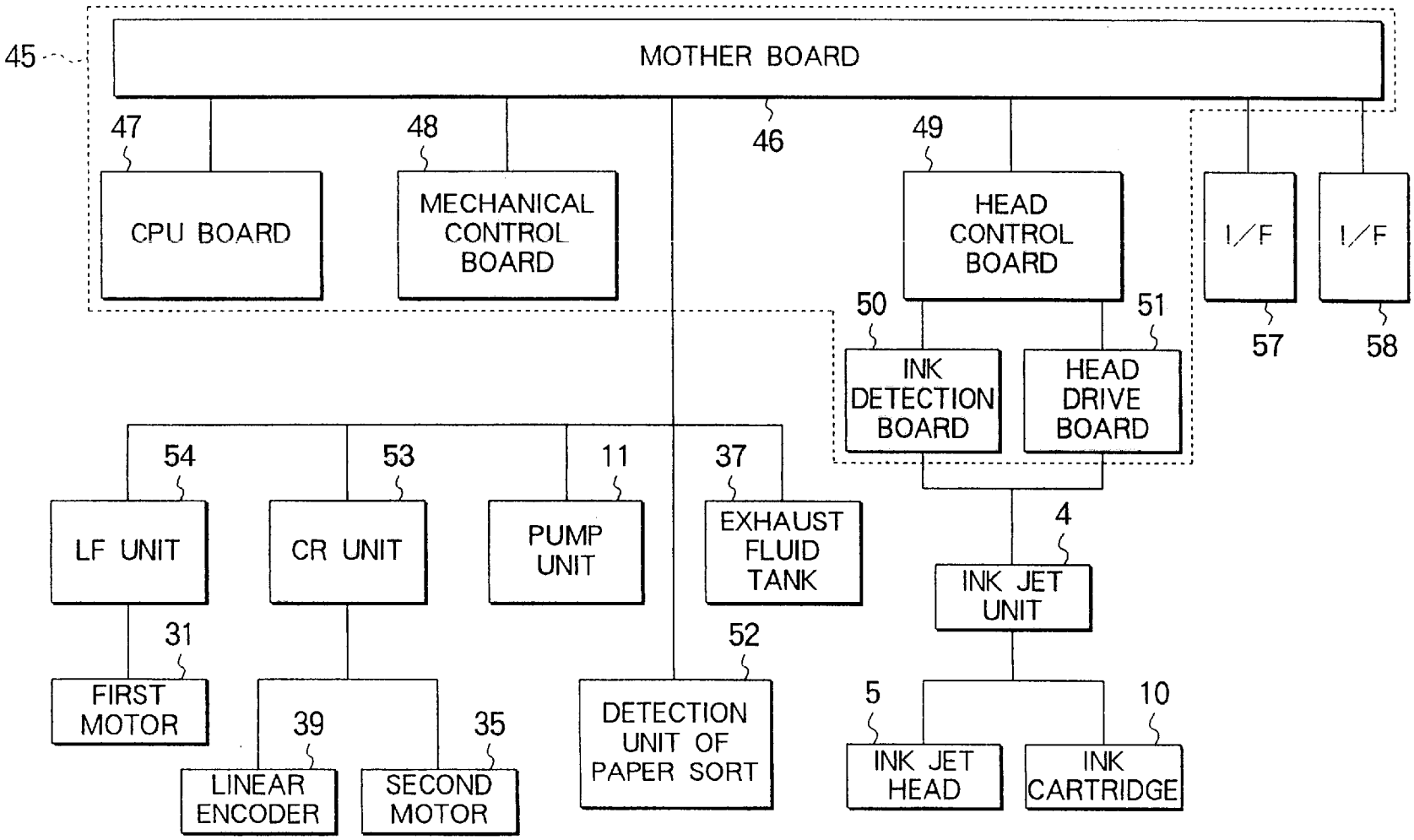
FIG. 5 is a block diagram of printing device shown in FIG. 3 and FIG. 4.

FIG. 5 shows a control block diagram of printing device including said controller 45.

As shown in FIG. 5, said controller 45 as electricity feeding control portion of the whole printing device consists of a mother board 46 having a control panel; a CPU board 47, a mechanical control board 48 and a head control board 49 connected to each other via said mother board 46; and an ink detection board 50 and a head drive board 51 connected to said head control board 49.

Said CPU board 47 has built-in CPU, ROM, RAM and the like, among which ROM has programs for operation and graphic processing written therein. Said head control board 49 is connected to and controls a detection unit of paper type 52 for detecting the type of paper to be used correspondingly to signals from said CPU; said pump unit 11; a CR unit 53 for driving said second motor 35 shifting said ink jet unit 4; a LF unit 54 for driving said first motor 31 conveying said roll paper 33*a*. Said mechanical control board 48 includes drivers (not shown) for driving said detection unit of paper type 52, pump unit 11, CR unit 53 and LF unit 54. Further, said mechanical control board 48 can transfer signals from said exhaust liquid tank 37 and said detection unit of paper type 52 to said CPU of said CPU board 47.

Said head control board 49 transfers a detection signal of residual ink quantity detected by said ink detection board 50 located on said ink jet unit 4 to said CPU of said CPU board 47, and, in said head drive board 51, said head control board 49 also transfers logical signals based on information from said CPU for driving said ink jet unit 4. Based on said logical signals, said head drive board 51 generates driving signals for driving respective ink jet head 5 and respective ink cartridge 10. For exchanging ink types, said ink cartridge 10 must be exchanged.

Further, in said CR unit 53, said linear encoder 39 is connected in parallel to said second motor 35, said linear encoder 39 outputting to said CPU of said CPU board 47 signals correspondingly to rotational speed of said second motor 35 for equalizing the shifting speed of said ink jet unit 4.

Further, said mother board 46 is provided with interface unit (I/F) 57, 58 for connecting this printing device to personal computer and the like.

Figure 6:
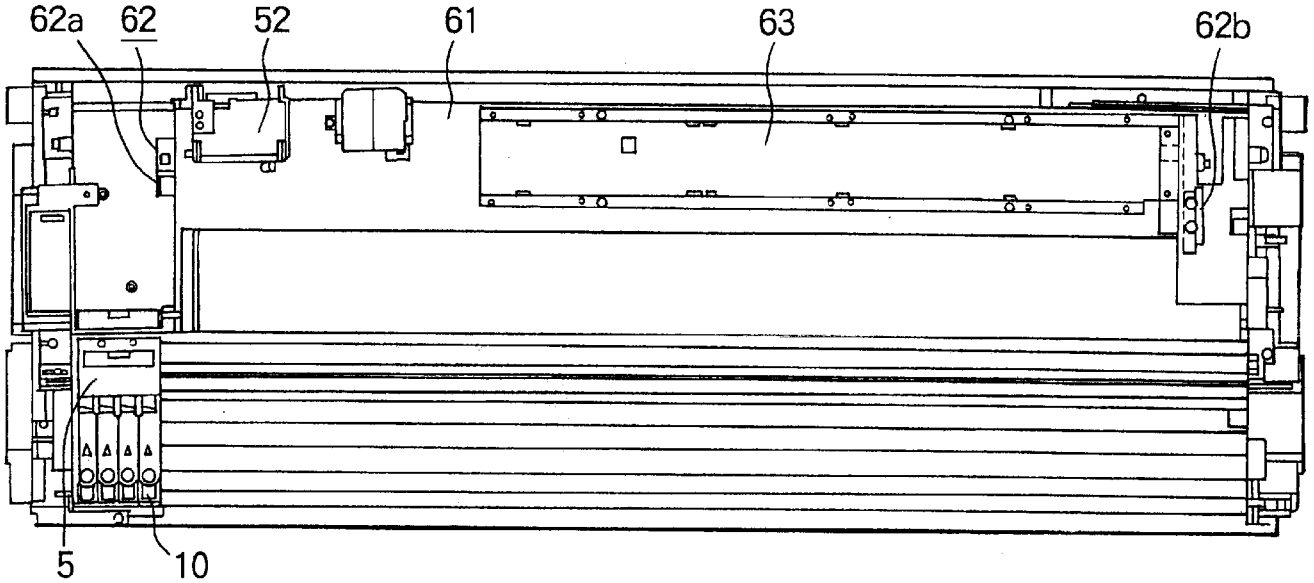
FIG. 6 is a plan view showing roll holding mechanism in the first embodiment.

As shown in FIG. 6, said paper roll 33 is supported on a pair of roll holders 62*a*, 62*b* of a roll holding mechanism 62 located on left and right portions of base 61 of printing device with a suitable distance between them. One of said holder pair, i.e. roll holder 62*b* on the right side is detachably mounted in any positions provided on a holder supporting plate 63 so as to be shifted according to the width of said roll paper 33*a*.

Figure 7:
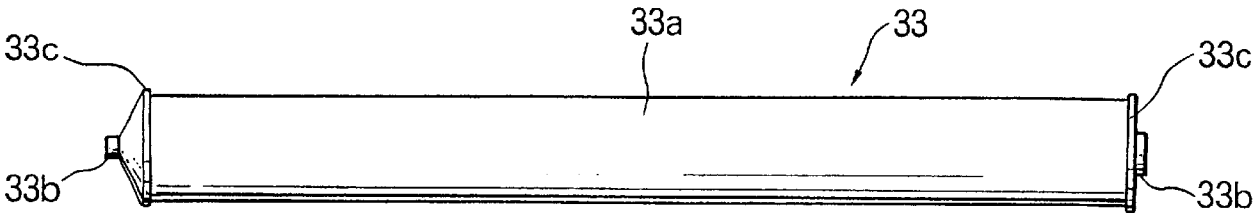
FIG. 7 is a front view of paper roll used in the first embodiment.

As shown in FIG. 7, said paper roll 33 comprises said roll paper 33*a* wound on a paper tube (not shown), said paper tube having paper tube holders 33*b*, 33*b* mounted on its both ends, and these paper tube holders being held respectively by said roll holder 62*a*, 62*b*. Said each paper tube holder 33*b*, 33*b* has round flange portion 33*c* having a diameter larger than that of roll paper 33*a*. According to the invention, the diameter of said flange portions 33*c* has different size according to the type of roll paper 33*a* wound on said paper tube, i.e. common paper, coat paper, film for OHP, back print film, burnished film and the like. Accordingly, one can identify the paper type according to the diameter of flanges 33*c* used.

Figure 8:
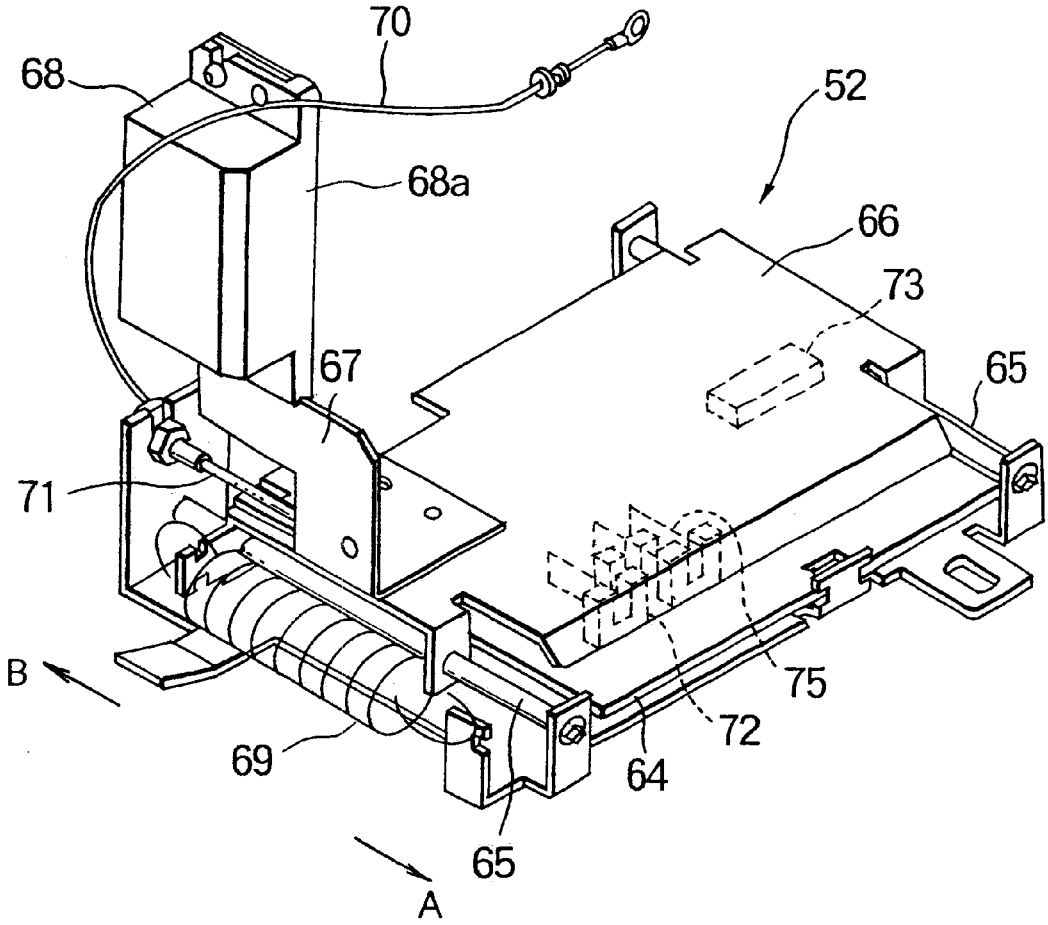
FIG. 8 is an enlarged perspective view of paper type detection means (unit) used in FIG. 6.

As shown in FIG. 8, said detection unit of paper type 52 for outputting detection signals for detecting type of said roll paper 33*a* has a base plate 64 located adjacent to one of said roll holders 62*a*. Said base plate 64 supports above it a pair of parallel guide rods 65, 65 which are parallel to each other and extend in horizontal direction so as to vertically cross the axis of said paper roll 33. A sliding table 66 is mounted on said guide rods 65, 65 so as to shift along the extending direction of said guide rods 65. A bracket 67 extends upwardly on the one end of said sliding table 66, and said bracket 67 supports thereon a flange abutting block member 68 having its one side surface 68*a* used as A flange abutting surface.

A coil spring 69 is provided between said base plate 64 and said sliding table 66 so as to urges said sliding table 66 in the direction A shown in FIG. 8 for pressing said flange abutting member 68 onto said flange 33*c* of said paper roll 33.

One end of a wire 70 as a manipulating member is connected to said bracket 67. On the other hand, a hollow tube 71 is fixed on a edge portion of said base plate 64 so as to extend from the fixing point of said wire 70 on said bracket 67 in a reverse direction B to the urging direction A of said coil spring 69. Said wire 70 passes through said tube 71 and extends outside of said base plate 64, the other end of said wire 70 being fixed onto said cover 30A (FIG. 4). Consequently, when opening said cover 30A, said sliding table 66 is shifted by said wire 70 in the direction B against the urging force of said coil spring 69. Accordingly, when exchanging paper roll 33, said flange abutting member 68 as an example of roll holder abutting member is retracted into a retracted position. Further, when said cover 30A is closed, said wire 70 is relaxed and said sliding table 66 is pulled in the direction A due to the urging force of said coil spring 69.

Figure 9:
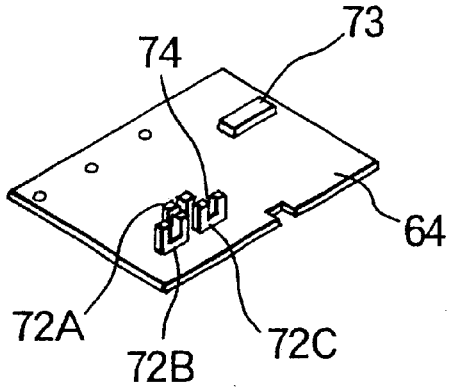
FIG. 9 is a perspective view of essential portion of FIG. 8.

As shown in FIG. 9, three photosensors 72A, 72B, 72C and an output connector 73 for outputting signals from respective sensors 72 to said controller 45 (FIG. 5) are located on said base plate 64. Said respective sensors 72 have respectively a U-form, and three state setting sheets 75 having each plate form to be inserted into the hollow portions of corresponding sensors 72 are supported on the rear side surface of said sliding table 66 so as to engage into respective sensors 72. Each state setting sheet 75 is a shielding plate for shielding light from light emitting portion of each sensor so as not to reach light receiving portion thereof, while said state setting sheet 75 has slits (not shown) allowing light from light emitting portion thereof to reach light receiving portion thereof.

Each sensor 72 has a construction such that it outputs signal ON when light from light emitting portion reaches light receiving portion, while it outputs signal OFF when light from light emitting portion does not reach light receiving portion. As a result, the position of sliding table 66 with respect to said base plate 64 is changed correspondingly to diameter of said flange 33*c* at the end of paper roll 33. Thus, each sensor 72A, 72B and 72C outputs ON signal or OFF signal to said CPU board 47 (FIG. 5) according to the position of said slits of corresponding state setting sheet 75.

Said CPU of said CPU board 47 can thus detect the type of paper (roll paper 33*a*) according to the flange diameter obtained by combination of ON or OFF signals issued from respective three sensors 72 as shown in the following Table 3.

The types of paper thus detected are output to said CPU board 47 and are displayed on a displaying panel (not shown) of ink jet printing device. Sensors A, B and C shown in this Table designated respectively said sensors 72A, 72B and 72C.

TABLE 3

| Paper Type | Flange Diameter (mm) | Sensor A | Sensor B | Sensor C |
|---|---|---|---|---|
| No paper | 0 | ON | ON | ON |
| 1 | 48–52 | OFF | ON | OFF |
| 2 | 58–62 | OFF | OFF | ON |
| 3 | 70–74 | ON | OFF | ON |
| 4 | 80–84 | OFF | ON | ON |
| 5 | 88–92 | ON | ON | OFF |
| 6 | 98–102 | ON | OFF | OFF |

Said CPU board 47 can carry out image processing and driving of ink jet heads 5 shown in Table 4 correspondingly to detected type of paper. As shown in Table 4, Paper type 1–3 can be adequately processed by the standard setting of printing device, but not Paper types 4–6.

TABLE 4

| Paper Type | Image Processing | Paper Feeding | Ink Jet Head |
|---|---|---|---|
| 1 | Standard | Standard | Standard Drive |
| 2 | Standard | Standard | Standard Drive |
| 3 | Standard | Standard | Standard Drive |
| 4 | Dedicated | Standard | Less Ink Ejecting |
| 5 | Dedicated | Double | Standard Drive |
| 6 | Standard | Standard | Double Scan Speed |

Flow of operations of above described printing device is now described below with respect to automatic detection of printing paper, driving conditions of ink jet heads, image processing and the like concerning to the present invention.

First, cover 30A is opened for mounting a paper roll 33 including a desired type of roll paper 33*a* onto roll holding mechanism 62. Wire 70 connected to this cover 30A is thus pulled in the direction B against the urging force of coil spring 69, so that sliding table 66 connected to this wire 70 is also pulled in the same direction B and flange abutting member 68 is retracted into a retraction place so as not to impede inserting operation of paper roll 33. In this state of mechanism, holders 33*b* having each flange 33*c* of outer diameter adapted to that of roll paper 33*a* mount paper roll 33 on both roll holders 62*a*, 62*b* of roll holding mechanism 62.

Then, upon closing of cover 33A, wire 70 is relaxed, sliding table 66 shifts in the direction A under the urging force of coil spring 69, and abutting surface 68*a* of flange abutting member 68 is urged onto peripheral surface of flange 33*c*. Correspondingly to the position of thus stopped sliding table 66, three sensors 72 are respectively ON state or OFF state, so that type of paper is detected as shown in Table 3. This information is output from output connector 73 to said CPU board 47 which detects type of paper based on Table 3 and can indicate predetermined image processing and head driving corresponding to detected type of paper.

Upon switching printing device electric source into ON, CPU of CPU board 47 initializes respective parts 48, 49, 50, 51 and respective units 4, 11, 52, 53, 54 and then recognizes type of paper use, i.e. anything of fine type paper, back print type, cloth and the like.

Since type of paper can be automatically detected upon mounting of said paper roll 33 onto roll holder 62*a*, 62*b* as described above, double printing and/or inferior image quality due to input error of paper type by operator can be prevented. Further, since paper used is automatically detected according to outer diameter of flanges 33*c*, more various types of paper can be handled by increasing the number of sensors. Further, since flange abutting member 68 is retracted when exchanging paper roll 33, flange abutting member 68 does not impede the exchange of paper roll 33.

From the information about ink type stored in a nonvolatile memory in head control board 49, said CPU receives signals for recognizing ink type, i.e. dyestuff type or pigment type. By using the data of detected type and type of ink and/or paper, said CPU looks up data table written in ROM of said CPU board 47, thereby to set driving conditions of ink jet head 5 such as driving voltage and frequency adapting to said detected ink type and to set also an image processing mode adapting to detected paper type.

One example of said driving voltage adapting to ink type is 80V when using dyestuff type ink and 70V when using pigment type ink, while example of driving frequency adapting to ink type is 3.0 KHz for dyestuff type ink and 2.7 KHz for pigment type ink. When changing driving frequency of ink jet head 5, the time period necessary for ink ejecting from ink jet head 5 is also changed, so that shifting velocity of ink jet unit 4 must be changed with respect to said change of ink ejecting time period. In this case, said CPU determines servo-constants for determining printing velocity.

On the other hand, said CPU sets an image processing mode adapting to said type of paper. This image processing mode comprises dedicated image processing A adapting to fine type paper, dedicated image processing B adapting to back print type paper and dedicated image processing C adapting to cloth type materials.

In said dedicated image processing A, when fine type paper can absorb no more ink at overlapping of a number of ink colors, bringing about too much dot number per surface unit with a too much high ink concentration, said dot number aimed at paper from ink jet head 5 is reduced so as to improve absorption of ink into paper.

In said dedicated image processing B which is adaptable to back print type paper, in the case when black color on paper is too low, in place of using only black ink for forming black image, cyan ink, magenta ink and yellow ink are overlapped on a black image formed by black ink, uniformly and with a reduced proportion of dot number of said black ink from ink jet head 5, thereby to increase concentration of black image.

Further, in said dedicated image processing C which is adaptable to materials tending to absorb too much ink such as cloth, when ink concentration on printing materials as a whole is too much low, all ink colors are double printed on all dot points.

By carrying out image processing which is adaptable to type of paper used as described above, a high quality printing can be assured notwithstanding paper type.

In these conditions, when an initiating command is received through interface unit 57 or 58 from outer source such as a personal computer, CPU researches operation history of the printing device concerned for carrying out initiating process of printing based upon said operation history.

In this case, when roll paper 33*a* has been cut by cutting section 40, said CPU determines back feeding quantity of roll paper 33*a* correspondingly to the front end position of roll paper 33*a* detected by said second paper detector 44 and sets roll paper 33*a* at the printing beginning position.

Printing information such as images and characters which is fed following said printing beginning command is processed into printing data adapting to ink type and paper type used, and these printing data are stored in RAM in said CPU board 47.

Then, said CPU of said CPU board 47 sends command to second motor 35 in said CR unit 53, and adjust said command based on signals from said linear encoder 39, thus servocontrolling for unifying shifting velocity of said ink jet unit 4 thereby to stabilize printing quality.

On the other hand, said printing data stored in RAM of said CPU board 47 are input into ink jet unit 4 as driving signals to respective ink jet heads 5, synchronously with signals from said liner encoder 39, via said head control board 49 and head drive board 51 for ejecting ink from nozzles of these ink jet heads 5 and printing desired dots on roll paper 33*a*.

After printing of roll paper 33*a* has been finished, the rear portion of said roll paper 33*a* is cut by said cutting section 40 to form a separate sheet and to exhaust this paper sheet thereby to obtain a printed sheet of paper.

Table 5 shows the test results wherein three types of materials, i.e. fine type, back print type and cloth were printed using two types of ink, i.e. dyestuff type and pigment type in the printing device according to the invention.

TABLE 5

| Type of Ink | Type of Paper | Driving Volt of Head | Driving Frequency of Head | Image Processing Mode | Result |
|---|---|---|---|---|---|
| Dyestuff | Fine | 80 V | 3.0 KHz | Standard | Good |
| Dyestuff | Back Print | 80 V | 3.0 KHz | Standard | Good |
| Dyestuff | Cloth | 80 V | 3.0 KHz | Standard | Good |
| Pigment | Fine | 70 V | 2.7 KHz | Processing A | Good |

TABLE 5-continued

| Type of Ink | Type of Paper | Driving Volt of Head | Driving Frequency of Head | Image Processing Mode | Result |
|---|---|---|---|---|---|
| Pigment | Back Print | 70 V | 2.7 KHz | Processing B | Good |
| Pigment | Cloth | 70 V | 2.7 KHz | Processing C | Good |

As shown in FIG. 5, when printing was carried out using dyestuff type ink, with driving conditions of ink jet head 5 such as driving volt of 80V and driving frequency of 3.0 KHz and standard image processing mode, ink ejected from nozzles of ink jet head 5 runs straight forward and reaches upon printing materials in a stable manner, so that any type of materials such a fine type, back print type and cloth could be printed with excellent printing quality.

On the other hand, when printing was carried out on fine type of paper using pigment type of ink and driving conditions of ink jet head 5 such as driving voltage of 70V and driving frequency of 2.7 KHz in said dedicated image processing mode A, a good result of printing could be obtained. Further, when printing was carried out using pigment type of ink and with the same driving conditions of said ink jet head 5 as those for said fine type of paper in a dedicated image processing mode B for back print type of paper B and in a dedicated image processing mode C for cloth, good results of printing could be obtained for both cases.

Second Embodiment, FIGS. 10–14

With reference to FIGS. 10–14, second embodiment of printing device which can discriminate automatically the types of paper used is shown diagrammatically. Only the portions which are different from those of the first embodiment, specifically which are related to detection of paper are described below.

Paper roll 80 used in this embodiment comprises a tube core 80*a* and roll paper 80*b* wound on said core 80*a*. A holder 81 as intermediate holder is mounted on the one end of said core. 80*a*. Said holder 81 comprises a cylindrical tube 81*a* fitted into said core 80*a*, a holder body 81*b* connected to said fitted tube 81*a* as a unit and having a larger outer diameter than that of said core 80*a*, and a flange 81*c* as a disc formed on the periphery of said holder body 81*b* at its inner end and having a larger diameter than the largest diameter of said paper roll 80*b*. According to the invention, the peripheral surface of said holder body 81*b* has a predetermined color, so that the combination of predetermined outer diameter and color of particular holder body 81*b* can specify the type of roll paper 80*b* held by the holder 81, i.e. common paper, coat paper, film for OHP, back print film, burnished paper and the like.

More specifically, outer diameter and color of holder body 81*b* are used as discriminating elements of type of roll paper 80*b* according to the invention. Said discriminating colors can be different colors such as red or blue, or can have different concentration of the same color. Otherwise, in place of holder body 81, diameter and color of said flange 81*c* formed on said holder body 81*b* can be detected.

Figure 10:
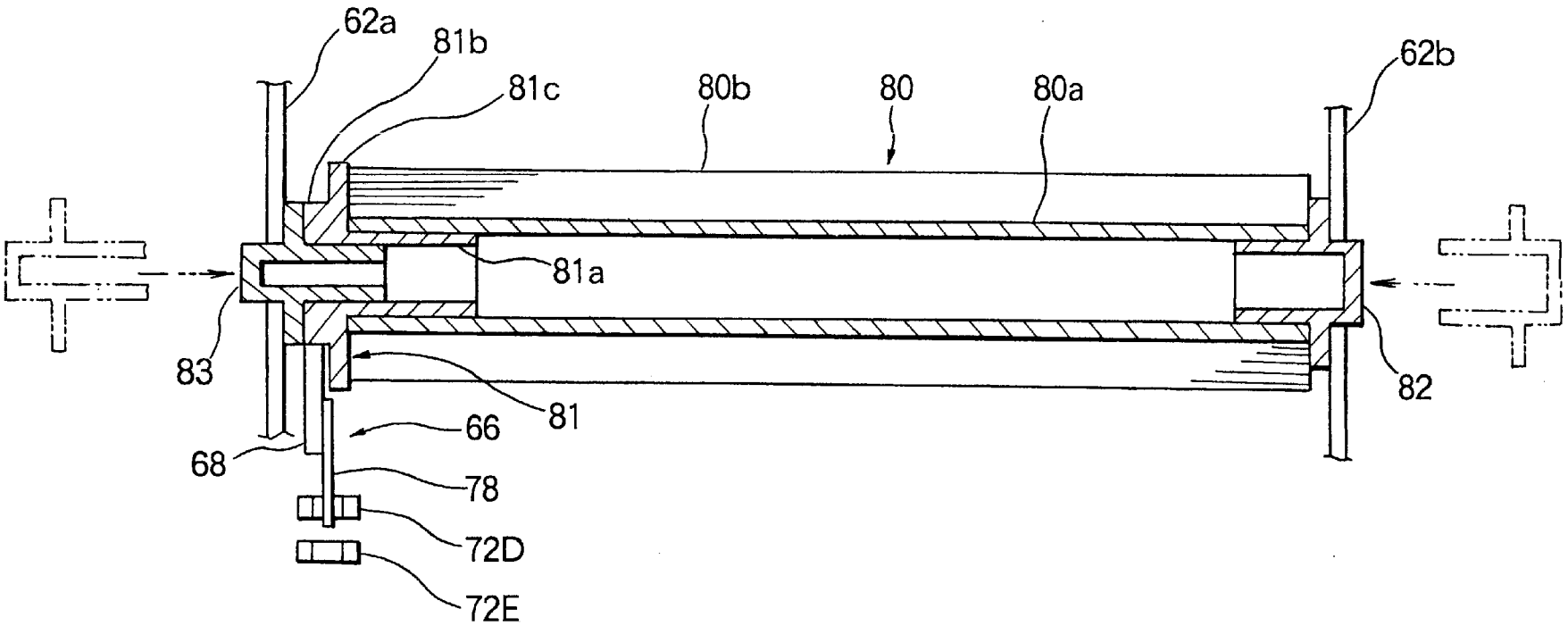
FIG. 10 is a cross-sectional view showing paper roll and paper type detection means used in second embodiment of the invention.
Figure 11:
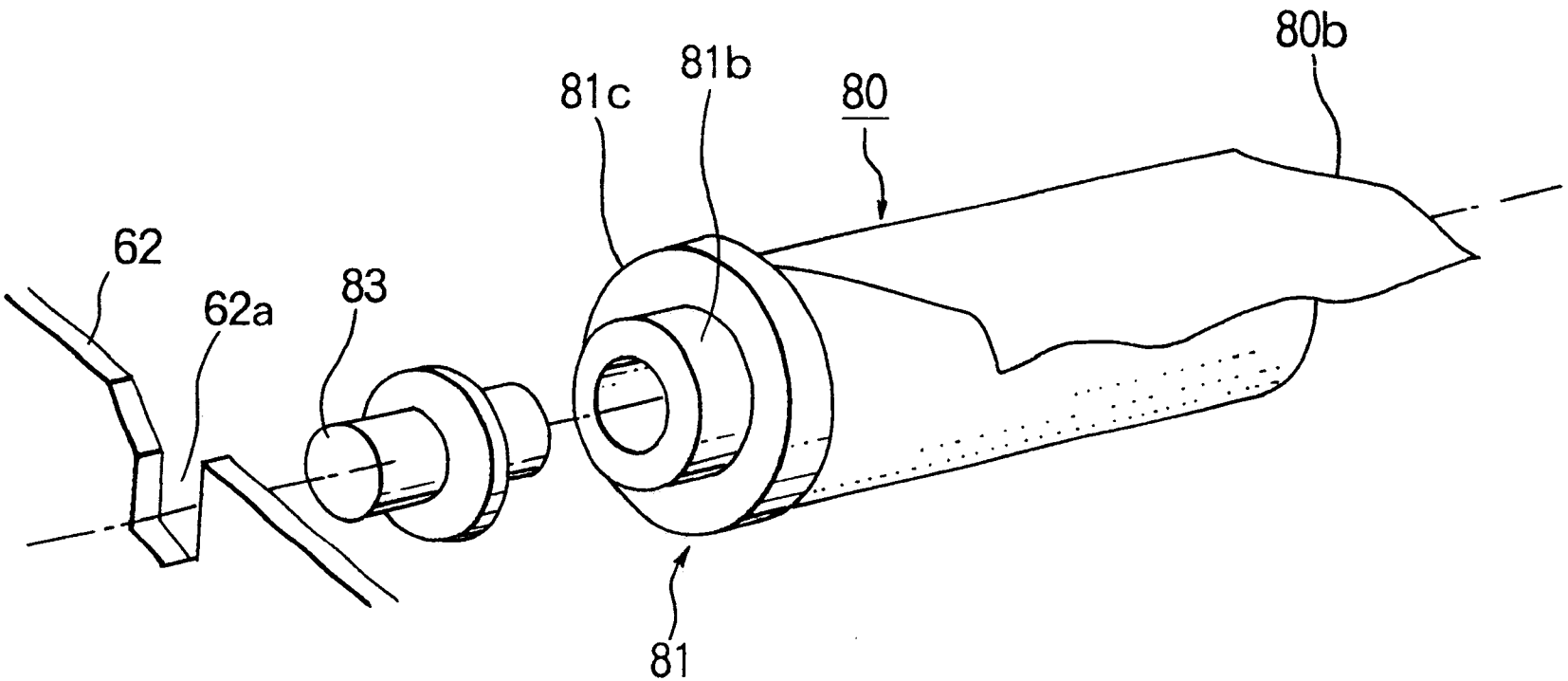
FIG. 11 is an exploded perspective view shown holding mechanism at one end of paper roll.

As shown in FIG. 10, additional holder 82 of usual shape which does not contribute to detection of paper type is attached on the other end of said core 80*a*. Further, said holder 81 has an auxiliary holder 83 fitted thereinto, so that said paper roll 80 is charged into roll holders 62*a*, 62*b* of roll holding mechanism 62.

Figure 12:
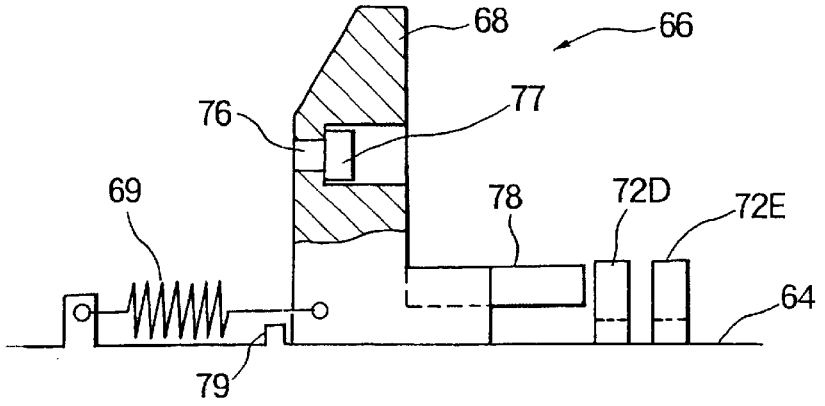
FIG. 12, FIG. 13 and FIG. 14 are side views showing the steps of action of paper type detection means.

Said paper type detection unit 52 which outputs signals for detection of type of said roll paper 80*b* has, as shown in FIG. 12, a sliding unit 66 which is slidable on a base plate 64 in the direction to and from said holder 81 (FIG. 10). A holder abutting member 68 projects from the upper side surface of said sliding table 66, the front side of said holder abutting member 68 being opposed against the peripheral surface of said holder body 81*b*. One end of said sliding table 66 supports a coil spring 69 which urges said holder abutting member 68 so as to approach said paper roll 80.

A small hole 76 is formed on the front side surface 68*a* of said holder abutting member 68 so as to be opposed to said peripheral surface of said holder body 81*b*, said small hole 76 serving as means for reading the discriminating agent, i.e. outer diameter and color of said holder body 81*b*. A light sensor 77 is provided in said holder abutting element 68 so as to be opposed to said holder body 81*b* through said small hole 76.

Further, towards the end portion of said sliding table 66, a shield plate 78 as a state setting member protrudes from said holder abutting member 68 in the horizontal direction on the side contrary to said urging direction of said sliding table 66. Further, two sets of photosensors 72D, 72E are located with a distance between them in the shift direction of said shield plate 78 so that photodiode and phototransistor thereof are opposed to each other on both sides of shifting way of said shield plate 78. Therefore, said shield plate 78 protruding from said sliding table 66 changes its stopping position correspondingly to that of said sliding table 66 changing also according to outer diameter of said holder body 81*b*, so that signals from said both photosensors 72D, 72E allow for detecting outer diameter of said holder 81*b*.

Furthermore, a stopper 79 protrudes from the upper surface of said base plate 64 for the purpose of stopping said sliding table 66 in a state where said shield plate 78 is not opposed to said both photosensors 72D, 72E as a result of urging of said sliding table 66 by said coil spring 69 when said paper roll 80 is not charged in said printing device. Since other components comprising said paper type detection unit 52 are the same as those of the above described embodiment, these other components are not described herein in detail.

In the present embodiment, detection of paper type is carried out based upon data detected both first paper type detection unit for detecting type of roll paper 80*b* based on the position of said flange abutting member 68, and second paper type detection unit for detecting the color element of said holder body 81*b* corresponding to type of said roll paper 80*b*.

More specifically, said first paper type detection unit consists of two sets of photosensors 72D, 72E for detecting the stopping position of said shield plate 78. As shown in FIG. 12, since said sliding table 66 is pulled up to said stopper 79 and stopped there by urging force of said coil spring 69 when said paper roll 80 is not charged into said printing device, said shield plate 78 take a position where it is not opposed any of sensors 72D, 72E. When a paper roll 80 having a holder body 81*b* of smaller diameter is charged into said printing device, said sliding table 66 is pulled by the urging force of said coil spring 69. However, said table 66 takes a backward position in comparison to FIG. 12, so that said shield plate 78 is not opposed to one photograph 72E, but shields only the other photosensor 72D which is nearer to said paper roll 80. In the same manner, when a paper roll 80 having said holder body 81*b* of larger diameter, said flange abutting member 68 is retracted farther, as a result of which said shield plate 78 comes to shield both photosensors 72D, 72E. Accordingly, any of ON signal and OFF signal is output from said sensors 72D, 72E correspondingly to outer diameter of holder body 81*b* holding paper roll 80 charged into said printing device.

Figure 13:
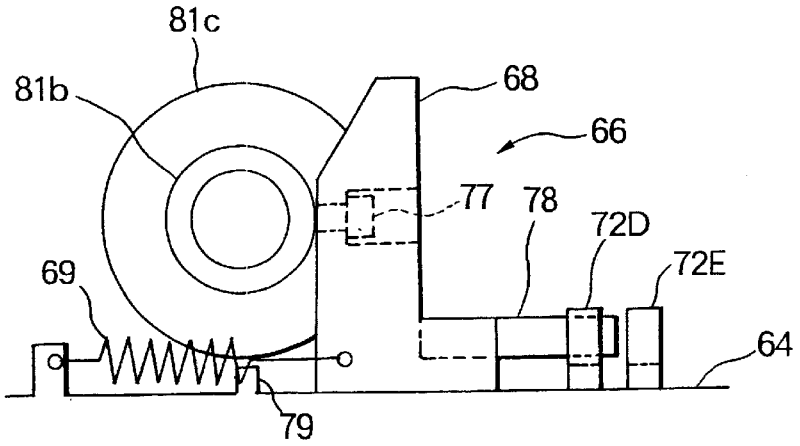
Figure 14:
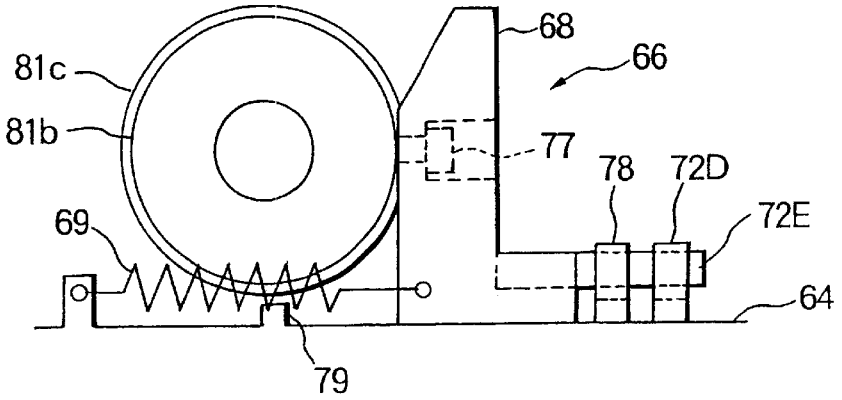

On the other hand, said light sensor 77 as second paper type detection unit is opposed to holder body 81*b* for detecting its color or concentration, as shown in FIG. 13.

Said CPU board 47 (FIG. 5) detects the type of paper (roll paper 80*b*) due to the combination of ON/OFF signal from said first paper type detector and signals showing color elements obtained from said second paper type detector.

Supposing that said light sensor 77 discriminates two types of color, for example black and white, the combination of colors and outer diameters of said holder body 81*b* allows for detection of 2×2, i.e. four types of paper.

When using color concentration as discriminating element and adding a gray color in addition to black and white, it becomes possible to detect 3×2=6 types of paper due to combination of three colors and two diameters. Further, when using two reflecting type light sensors of red and green, four colors such as white, red, green and black can be discriminated. Thus in this case, 4×2=8 types of paper can be detected due to the combination of colors and diameters. Further, by discriminating types of holders 81 located on both ends of said paper roll 33 by means of respective sensors 77, 72D and 72E, a considerable number of types can be detected by the combination thus obtained.

This information is output from said output connector 73 to said CPU board 47, which detects types of paper based on signals of said three sensors output from said paper type detection unit 52 and issues instructions for predetermined image processing and head driving correspondingly to types of paper thus detected. It goes without saying that relationship between the combination of colors and diameters of holder 81 and the types of paper is preset in ROM of CPU and the like.

The present invention is not limited to the above described embodiments, but can be modified if necessary. For example, as element for ink ejecting, in place of said piezo element as electrostrictive vibrator, one can use a thermal head which subject thermal expansion to ink thereby to eject it from nozzles. When a type of paper designated as a result of paper detection is not adapted to the print mode, control board 45 can issue an alarm requesting exchange of paper or print mode.

What is claimed is:

1. A device for printing paper from a pre-wound roll having an end flange of selectable diameter defining type of wound on the roll, comprising:

a. a frame for rotatably holding the roll and defining a path for paper transport;

b. a table slidably movable along said frame responsively to rolling contact with said flange according to contacted flange diameter;

c. a mechanism for rotatably permitting paper roll, comprising paper roll holders mounted concentrically on at least one end of said roll and connected to said frame, the combination of outer diameter and color of a peripheral surface of said paper roll holder corresponding to the type of said roll paper;

d. light transmitting and blocking members connected to said table and moving along said frame unitarily with said table;

e. light sensitive means fixedly connected to said frame and positioned to receive light through or be blocked from receiving light by said transmitting and blocking members according to position of said table along said frame and producing an electrical signal indicative therefor;

f. means for storing data reflecting type of ink available for dispensing;

g. a movable print head adapted for emitting ink supplied thereto against paper unwound from said roll;

h. means for optically detecting a color characteristic of said holder and producing an electrical signal indicative thereof;

i. means for comparing said signals indicative of table position and color characteristic with preselected stored data reflecting acceptable printing for the combination of detected paper type and available ink and determining appropriate image processing and print head driving parameters;

j. means for operating said print head according to said driving parameters to print said processed images on said paper advanced from said roll.

2. A device as claimed in claim 1 further characterized by auxiliary holders fitted into said holder for mounting said paper roll on said paper roll holding mechanism.

3. The device of claim 1 wherein said light sensitive means are of "U" shape light transmitting and said light blocking members fit into the interior of the "U" shapes.

4. The device of claim 3 wherein the U-shaped cells are below said table and said light transmitting and blocking members are connected to a downwardly facing surface of said table.

5. The device of claim 4 wherein said light transmitting and blocking members are planar.

6. The device of claim 5 wherein said transmitting and blocking members are perpendicular to said table.

7. The device of claim 4 wherein at least some of said transmitting and blocking members include apertures therein for transmission of light therethrough.

8. The device of claim 7 wherein said apertures are in the form of slits.

9. The device of claim 8 wherein said slits are arranged to allow different patterns of light to pass therethrough according to the position of said table as a function of the diameter of said roll flange thereby to affect different output signals corresponding to characteristics of said paper.

10. The device of claim 1 wherein the legs of said "U" shape are parallel with the direction of movement of said table.

11. A device for printing paper from a pre-wound roll having an end flange of selectable diameter defining the type of paper wound on said roll, comprising:

a. a frame for holding the roll and defining a path for paper transport;

b. a table slidably movable along said frame;

c. means for contacting said flange and movably positioning said table respecting said frame according to the contacted diameter of said flange;

d. light transmitting and blocking members connected to said table and moving along said frame unitarily with said table;

e. light sensitive means connected to said frame and positioned to receive light through or be blocked from receiving light by said blocking members according to position of said table along said frame, for producing a signal indicative of position of said table relative to said frame and indicative of said type of paper wound on said roll;

f. means for storing information indicative of type of ink available in a reservoir for dispersal by a movable print head and providing a signal indicative of ink type;

g. means receiving said signals indicative of ink and paper type, for comparing said signals in digital form to previously stored digital data defining print head drive voltage and frequency and to previously stored digital data defining image processing mode for the current ink and paper types and driving and operating said print head at said indicated voltage and frequency to create print images in the indicated mode on said paper unwound from said roll.

12. A device for printing paper from a pre-wound roll having an end flange of selectable diameter defining type of paper wound on the roll, comprising:

a. a frame for rotatably holding the roll and defining a path for paper transport;

b. a table slidably movable along said frame responsively to rolling contact with said flange according to contacted flange diameter;

c. light transmitting and blocking members connected to said table and moving along said frame unitarily with said table;

d. light sensitive means fixedly connected to said frame and positioned to receive light through or be blocked from receiving light by said transmitting and blocking members according to position of said table along said frame, and producing an electrical signal indicative thereof;

e. means for storing data reflecting type of ink available for dispensing;

f. a movable print head adapted for emitting ink supplied thereto against paper unwound from said roll;

g. means for optically detecting a color characteristic of said end flange and producing an electrical signal indicative thereof;

h. means for comparing said signals indicating table position and color characteristic with preselected stored data reflecting acceptable printing for the combination of detected paper type and available ink and determining appropriate image processing and print head driving parameters;

j. means for operating said print head with said appropriate driving parameters to produce said processed images on paper unwound from said roll.

13. A method for printing paper from a pre-wound roll having an end flange of selectable diameter defining type of paper wound on the roll, comprising the steps of:

a. moving a table slidably along a frame responsively to rolling contact with said flange according to contacted flange diameter;

b. rotatably advancing a paper roll having a core with paper wound on the core and a holding mechanism mounted concentrically on at least one end of the core, with a combination of outer diameter and color of a peripheral surface of the holding mechanism varying and corresponding to the type of the roll paper;

c. moving a light transmitting and blocking member connected to the table along the frame unitarily with the table;

d. producing an electrical signal according to whether light is received or blocked by the transmitting and blocking member according to position of the table along the frame;

e. optically detecting a color characteristic of the holding mechanism and producing an electrical signal indicative thereof;

f. comparing said table position and color characteristic signals with preselected stored data reflecting acceptable printing for the combination of detected paper type and available ink and determining corresponding appropriate image processing and print head driving parameters; and g. operating said print head with said driving parameters to produce print images.

14. A method for printing paper from a pre-wound roll having an end flange of selectable diameter defining the type of paper wound on said roll, comprising the steps of:

a. slidably moving a table along a frame holding the roll and defining a path for paper transport to movably position the table respecting the frame according to the flange diameter with light transmitting and blocking members connected to said table and moving along said frame unitarily with said table;

b. producing a signal indicative of type of paper wound on the roll according to receipt if any of an optical light signal as affected by said light transmitting and blocking members at a selected position of the table along the frame;

c. storing information indicative of available ink type in a reservoir supplying a movable print head and providing a signal indicative of available ink type;

d. digitally comparing said signals indicative of ink and paper type to previously stored data defining print head drive voltage and frequency and to previously stored data defining image processing mode for the current ink and paper types e. driving and operating said print head in response to said digital signal comparison at said indicated voltage and frequency to create print images in the indicated mode.

15. A method for printing paper from a pre-wound roll having an end flange of selectable diameter defining type of paper wound on a roll, comprising the steps of:

a. moving a table along a paper transport path frame which, rotatably holds the roll, responsively to rolling contact with said flange according to contacted flange diameter;

b. moving a light transmitting and blocking member along said frame unitarily with said table;

c. positioning light sensitive means to receive light through or be blocked from receiving light by said transmitting and blocking members according to position of said table along said frame;

d. producing an electrical signal indicative of receipt of light, if any, by said light sensitive means over range of table movement along said frame;

e. storing data reflecting type of ink available for dispensing;

f. providing a movable print head adapted for emitting ink supplied thereto against paper unwound from said roll;

g. optically detecting a color characteristic of said paper defined by said end flange diameter and producing an electrical signal indicative thereof;

h. comparing said signals indicative of table position and color characteristic with preselected stored data reflecting acceptable printing for the combination of detected paper type and available ink and determining appropriate image processing and print head driving parameters in accordance therewith; and i. operating said print head according to said driving parameters to produce said processed images.

* * * * *